US009214161B2

(12) United States Patent
Tsujino et al.

(10) Patent No.: US 9,214,161 B2
(45) **Date of Patent: *Dec. 15, 2015**

(54) AUDIO SIGNAL ENCODING METHOD, AUDIO SIGNAL DECODING METHOD, ENCODING DEVICE, DECODING DEVICE, AUDIO SIGNAL PROCESSING SYSTEM, AUDIO SIGNAL ENCODING PROGRAM, AND AUDIO SIGNAL DECODING PROGRAM

(71) Applicant: NTT DOCOMO, Inc., Tokyo (JP)

(72) Inventors: Kosuke Tsujino, Yokohama (JP); Kei Kikuiri, Yokohama (JP); Nobuhiko Naka, Yokohama (JP)

(73) Assignee: NTT DOCOMO, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/786,052

(22) Filed: Mar. 5, 2013

(65) Prior Publication Data

US 2013/0185085 A1 Jul. 18, 2013

Related U.S. Application Data

(63) Continuation of application No. 13/224,816, filed on Sep. 2, 2011, which is a continuation of application No. PCT/JP2010/053454, filed on Mar. 3, 2010.

(30) Foreign Application Priority Data

Mar. 6, 2009 (JP) ..... 2009-053693

(51) Int. Cl.
*G10L 19/00* (2013.01)
*G10L 19/26* (2013.01)
(Continued)

(52) U.S. Cl.
CPC ..... *G10L 19/26* (2013.01); *G10L 19/002* (2013.01); *G10L 19/18* (2013.01); *G10L 19/20* (2013.01); *G10L 19/22* (2013.01); *G10L 19/12* (2013.01); *G10L 19/24* (2013.01)

(58) Field of Classification Search
CPC ..... G10L 19/18; G10L 19/20; G10L 19/22; G10L 19/24
USPC ..... 704/203, 219, 500–504
See application file for complete search history.

(56) References Cited

U.S. PATENT DOCUMENTS 6,012,024 A * 1/2000 Hofmann ..... 704/219
6,134,518 A 10/2000 Cohen et al.
(Continued)

FOREIGN PATENT DOCUMENTS

FR 2969805 A1 6/2012
JP 09-152899 6/1997
(Continued)

OTHER PUBLICATIONS

3GPP TS 26.290 V7.0.0 (Mar. 2007) Technical Specification, "3rd Generation Partnership Project; Technical Specification Group Service and System Aspects; Audio codec processing functions; Extended Adaptive Multi-Rate-Wideband (AMR-WB+) codec; Transcoding functions (Release 7)," pp. 1-86. © 2007 3GPP Organizational Partners (ARIB, ATIS, CCSA, ETSI, TTA, TTC), Valbonne, France.
(Continued)

*Primary Examiner* — Samuel G Neway
(74) *Attorney, Agent, or Firm* — Brinks Gilson & Lione

(57) ABSTRACT

When a frame immediately preceding an encoding target frame to be encoded by a first encoding unit operating under a linear predictive coding scheme is encoded by a second encoding unit operating under a coding scheme different from the linear predictive coding scheme, the encoding target frame can be encoded under the linear predictive coding scheme by initializing the internal state of the first encoding unit. Therefore, encoding processing performed under a plurality of coding schemes including the linear predictive coding scheme and a coding scheme different from the linear predictive coding scheme can be realized.

10 Claims, 5 Drawing Sheets

(51) Int. Cl.

| | |
|---|---|
| ***G10L 19/20*** | (2013.01) |
| ***G10L 19/22*** | (2013.01) |
| ***G10L 19/18*** | (2013.01) |
| ***G10L 19/002*** | (2013.01) |
| *G10L 19/24* | (2013.01) |
| *G10L 19/12* | (2013.01) |

(56) References Cited

U.S. PATENT DOCUMENTS

| | | | | |
|---|---|---|---|---|
| 6,658,383 | B2 * | 12/2003 | Koishida et al. | 704/229 |
| 7,596,486 | B2 * | 9/2009 | Ojala et al. | 704/201 |
| 7,860,709 | B2 * | 12/2010 | Makinen | 704/219 |
| 7,876,966 | B2 * | 1/2011 | Ojanpera | 382/232 |
| 8,069,034 | B2 * | 11/2011 | Makinen et al. | 704/201 |
| 2005/0228648 | A1 * | 10/2005 | Heikkinen | 704/205 |
| 2007/0223577 | A1 | 9/2007 | Ehara et al. | |
| 2009/0083041 | A1 | 3/2009 | Yoshida | |
| 2011/0173008 | A1 * | 7/2011 | Lecomte et al. | 704/500 |
| 2012/0271644 | A1 | 10/2012 | Bessette et al. | |

FOREIGN PATENT DOCUMENTS

| | | | |
|---|---|---|---|
| JP | 11-242499 | | 9/1999 |
| JP | 11-243396 | | 9/1999 |
| JP | 2002-164796 | | 6/2002 |
| JP | 2003-44097 | | 2/2003 |
| JP | 2004-053676 | | 2/2004 |
| JP | 2011-527459 | | 10/2011 |
| WO | WO 2005/112005 | A1 | 11/2005 |
| WO | WO 2006/118179 | A1 | 11/2006 |
| WO | WO 2010/003663 | A1 | 1/2010 |
| WO | WO 2011/048117 | A1 | 4/2011 |

OTHER PUBLICATIONS

Patent Examination Report from Australian Application No. 2010219643, dated Aug. 3, 2012, 3 pages.
Patent Examination Report from Australian Application No. 2012204146, dated Jan. 23, 2013, 3 pages.
Patent Examination Report from Australian Application No. 2012204147, dated Jan. 23, 2013, 3 pages.
Patent Examination Report from Australian Application No. 2012204146, dated Feb. 27, 2013, 3 pages.
Patent Examination Report from Australian Application No. 2012204147, dated Feb. 28, 2013, 3 pages.
Extended European Search Report for European Application No. 12175685.2, dated Sep. 13, 2012, 7 pages.
Examination Report for European Application No. 12175685.2, dated Jan. 31, 2013, 4 pages.
Extended European Search Report for European Application No. 12175701.7, dated Sep. 13, 2012, 7 pages.
Examination Report for European Application No. 12175701.7, dated Jan. 31, 2013, 5 pages.
Extended European Search Report for European Application No. 10748784.5, dated Sep. 13, 2012, 7 pages.
Office Action from Russian Application No. 2011140533/08, dated Aug. 17, 2012, 5 pages.
Office Action from Russian Application No. 2012131495/08, dated Feb. 14, 2013, 5 pages.
Office Action from Russian Application No. 2012131496/08, dated Feb. 14, 2013, 5 pages.
Office Action from U.S. Appl. No. 13/224,816, dated Apr. 10, 2013, 18 pages.
Kövesi, Balàzs et al., "Integration of a CELP Coder in the ARDOR Universal Sound Codec," Interspeech 2006, ICSLP, 9$^{th}$ International Conference on Spoken Language Processing, Pittsburgh, PA, Sep. 17-21, 2006, 4 pages.
Lecomte, Jeremie et al., "Efficient cross-fade windows for transitions between LPC-based and non-LPC based audio coding," Audio Engineering Society, Convention Paper 7712, Presented at the 126$^{th}$ Convention, May 2009, Munich, Germany, 9 pages.
Neuendorf, Max et al., "Detailed Technical Description of Reference Model 0 of the CIP on United Speech and Audio Coding (USAC)," International Organisation for Standardisation, ISO/IEC JTC1/SG29/WG11, MPEG Meeting, MPEG2008/M15867, Coding of Moving Pictures and Audio, Oct. 2008, Busan, South Korea, 99 pages.
Neuendorf, Max et al., "Proposed Corrections to WD and Reference Software on Unified Speech and Audio Coding," International Organisation for Standardisation, ISO/IEC JTC1/SG29/WG11, MPEG Meeting, MPEG2009/M16153, Coding of Moving Pictures and Audio, Feb. 2009, Lausanne, Switzerland, 39 pages.
Office Action, dated Apr. 10, 2013, pp. 1-18, U.S. Appl. No. 13/224,816, U.S. Patent and Trademark Office, Alexandria, Virginia.
Summons to Attend Oral Proceedings, dated Jun. 10, 2013, pp. 1-4. European Patent Application No. 12175701.7, European Patent Office, Rijswijk, The Netherlands.
Summons to Attend Oral Proceedings, dated Jun. 10, 2013, pp. 1-4. European Patent Application No. 12175685.2, European Patent Office, Rijswijk, The Netherlands.
3GPP TS 26.290 V7.0.0 (Mar. 2007) Technical Specification, "3rd Generation Partnership Project; Technical Specification Group Service and System Aspects; Audio codec processing functions; Extended Adaptive Multi-Rate-Wideband (AMR-WB+) codec; Transcoding functions (Release 7)," pp. 1-86. © 2007 3GPP Organizational Partners (ARIB, ATIS, CCSA, ETSI, TTA, TTC), Valbonne, France.
International Search Report for International Application No. PCT/JP2010/053454, dated Jun. 8, 2010, pp. 1-2, International Searching Authority, Japanese Patent Office, Tokyo, Japan.

* cited by examiner

AUDIO SIGNAL ENCODING METHOD, AUDIO SIGNAL DECODING METHOD, ENCODING DEVICE, DECODING DEVICE, AUDIO SIGNAL PROCESSING SYSTEM, AUDIO SIGNAL ENCODING PROGRAM, AND AUDIO SIGNAL DECODING PROGRAM

RELATED APPLICATIONS

This application is a continuation of U.S. patent application Ser. No. 13/224,816, filed Sep. 2, 2011, which is a continuation of PCT/JP2010/053454 filed on Mar. 3, 2010, which claims priority to Japanese Application No. 2009-053693 filed on Mar. 6, 2009. The entire contents of these applications are incorporated herein by reference.

BACKGROUND OF THE INVENTION

1. Field of the Invention

The present invention relates to an audio signal encoding method, an audio signal decoding method, an encoding device, a decoding device, an audio signal processing system, an audio signal encoding program, and an audio signal decoding program.

2. Description of the Related Art

A coding technique for compressing speech/music signals (audio signals) at low bit rates is important to reduce the costs incurred in communications, broadcasting, and storing of speech and music signals. In order to efficiently encode both speech signals and music signals, a hybrid-type coding scheme is effective in which a coding scheme suitable for speech signals and a coding scheme suitable for music signals are selectively utilized. The hybrid-type coding scheme performs coding efficiently by switching coding schemes in the process of coding an audio sequence, even when the characteristics of input signals vary temporally.

The hybrid-type coding scheme typically includes, as a component, the CELP coding scheme (CELP: Code Excited Linear Prediction Coding) suitable for coding speech signals. Generally, in order to encode a residual signal obtained through application of a linear predictive inverse filter to an input signal, an encoder exercising the CELP scheme holds therein information about past residual signals in an adaptive codebook. Since the adaptive codebook is used for coding, a high coding efficiency is achieved.

A technique for coding speech signals and music signals is described, for example, in Patent Literature 1. In Patent Literature 1, a coding algorithm for coding both speech signals and music signals, etc. is described. The technique described in Patent Literature 1 utilizes a Linear Predictive (LP) synthesis filter functioning commonly to encode speech signals and music signals. The LP synthesis filter switches between a speech excitation generator and a transform excitation generator according to whether a speech signal or music signal is coded, respectively. For coding speech signals, the conventional CELP technique is used, and for coding music signals, a novel asymmetrical overlap-add transform technique is applied. In performing the common LP synthesis filtering, interpolation of the LP coefficients is conducted on a signal in overlap-add operation regions.

When switching takes place from a coding scheme other than the CELP coding scheme to a coding scheme exercising the CELP scheme in the process of coding an audio sequence, information on a residual signal corresponding to the speech coming before the switching is not held in an adaptive codebook in the encoder. Therefore, the coding efficiency degrades when coding a frame coming immediately after the switching of the coding scheme, resulting in a problem of degradation in the reproduced speech quality. Conventional art is known such as Adaptive MultiRate Wideband plus (AMR-WB+, Non Patent Literature 1), which is a speech coding scheme standardized by the 3rd Generation Partnership Project (3GPP), in which the internal state of an encoder exercising the CELP scheme is initialized, using an encoded result obtained under a coding scheme other than the CELP scheme. The AMR-WB+ encoder obtains a residual signal through the linear predictive inverse filtering on an input signal and thereafter encodes the residual signal selectively using two coding schemes, i.e., the CELP scheme and the Transform Coded Excitation (TCX) scheme. When switching from the TCX scheme to the CELP scheme, the AMR-WB+ encoder updates the adaptive codebook in the CELP scheme, using an excitation signal in the TCX scheme.

CITATION LIST

Patent Literature

Patent Literature 1: Japanese Patent Application Laid-Open No. 2003-44097

Non Patent Literature

3GPP TS 26.290 "Audio codec processing functions; Extended Adaptive Multi-Rate-Wideband (AMR-WB+) codec; Transcoding functions". [online].[retrieved on 5 Mar. 2009] Retrieved from the Internet: <URL:http://www.3gpp.org/ftp/Specs/html-info/26290.htm>

However, under a hybrid-type coding scheme in which a coding scheme based on the CELP scheme and a coding scheme not using linear predictive coding are selectively used, it is difficult to obtain an excitation signal from the coding process performed under a coding scheme not using the linear predictive coding. Therefore, when switching from a coding scheme not using the linear predictive coding to a coding scheme based on the CELP scheme, it is difficult to initialize the adaptive codebook in the CELP scheme with an excitation signal corresponding to the speech coming before the switching. An object of the present invention is to initialize, to an appropriate value, the internal state of a encoding unit or decoding unit exercising a coding scheme using the linear predictive coding to thereby improve the quality of a speech reproduced from a frame coming immediately after the switching, when switching from a coding scheme not using linear prediction to a coding scheme using the linear predictive coding.

SUMMARY OF THE INVENTION

An audio signal encoding method of the present invention encodes an audio signal, which includes a plurality of frames, using a first encoding unit operating under a linear predictive coding scheme and a second encoding unit operating under a coding scheme different from the linear predictive coding scheme. The audio signal encoding method of the present invention comprises a step of switching from the second encoding unit to the first encoding unit when encoding a second frame immediately succeeding a first frame after the second encoding unit encodes the first frame. The method further comprises a step of initializing an internal state of the first encoding unit according to a predetermined method after the switching step is performed.

According to the audio signal encoding method of the present invention, even when the second frame is to be encoded under a linear predictive coding scheme, whereas the first frame has been encoded by a coding scheme different from the linear predictive coding scheme, the second frame can be encoded under the linear predictive coding scheme by initializing the internal state of the first encoding unit operating under the linear predictive coding scheme. Therefore, encoding processing performed under a plurality of coding schemes including the linear predictive coding scheme and a coding scheme different from the linear predictive coding scheme can be realized.

In the present invention, the internal state of the first encoding unit preferably comprises a content of an adaptive codebook or values held by delay elements of a linear predictive synthesis filter for determining a zero input response. The internal state of the first encoding unit is preferably initialized using the first frame. Specifically, the internal state of the first encoding unit is preferably initialized, using a residual signal obtained by applying the linear predictive inverse filter to either the first frame yet to be encoded by the second encoding unit or the first frame decoded back after encoded by the second encoding unit. The linear predictive inverse filter is preferably applied to either the first frame yet to be encoded by the second encoding unit or the first frame decoded back after encoded by the second encoding unit, using linear predictive coefficients used by the first encoding unit to encode a third frame preceding the first frame. Alternatively, when linear predictive coefficients of the first frame are included in codes of the second frame, the linear predictive inverse filter is preferably applied to either the first frame yet to be encoded by the second encoding unit or the first frame decoded back after encoded by the second encoding unit, using the linear predictive coefficients included in the codes of the second frame. In the present invention, the internal state of the first encoding unit may be initialized using the internal state had by the first encoding unit when the first encoding unit encoded a frame preceding the first frame. As for the linear predictive coefficients in the linear predictive synthesis filter for determining a zero input response, when linear predictive coefficients used when the first encoding unit encoded the third frame preceding the first frame or the linear predictive coefficients of the first frame are included in codes of the second frame, it is desirable to use the linear predictive coefficients of the first frame calculated when the second frame is encoded or those obtained by applying an perceptual weighting filter to the calculated linear predictive coefficients.

An audio signal decoding method of the present invention decodes an encoded audio signal, which includes a plurality of frames, using a first decoding unit operating under a linear predictive coding scheme and a second decoding unit operating under a coding scheme different from the linear predictive coding scheme. The audio signal decoding method comprises a step of switching from the second decoding unit to the first decoding unit when decoding a second frame immediately succeeding a first frame after the second decoding unit decodes the first frame. The method further comprises a step of initializing an internal state of the first decoding unit according to a predetermined method, after the switching step is performed.

According to the audio signal decoding method of the present invention, even when the second frame is to be decoded using a linear predictive coding scheme, whereas the first frame is decoded by a coding scheme different from the linear predictive coding scheme, the second frame can be decoded under the linear predictive coding scheme by initializing the internal state of the first decoding unit operating under the linear predictive coding scheme. Therefore, decoding processing performed under a plurality of coding schemes including the linear predictive coding scheme and a coding scheme different from the linear predictive coding scheme can be realized.

In the present invention, the internal state of the first decoding unit preferably comprises a content of an adaptive codebook or values held by delay elements of a linear predictive synthesis filter. The internal state of the first decoding unit is preferably initialized using the first frame. Specifically, the internal state of the first decoding unit is preferably initialized, using a residual signal obtained by applying the linear predictive inverse filter to the first frame decoded by the second decoding unit. The linear predictive inverse filter is preferably applied to the first frame decoded by the second decoding unit, using linear predictive coefficients used when the first decoding unit decoded a third frame preceding the first frame. Alternatively, when linear predictive coefficients of the first frame are included in codes of the second frame, the linear predictive inverse filter is preferably applied to the first frame decoded by the second decoding unit, using the linear predictive coefficients included in the codes of the second frame. In the present invention, the internal state of the first decoding unit may be initialized, using the internal state had by the first decoding unit when the first decoding unit decoded a frame preceding the first frame.

An encoding device of the present invention includes a first encoding unit operating under a linear predictive coding scheme and a second encoding unit operating under a coding scheme different from the linear predictive coding scheme. The encoding device encodes an audio signal, using the first encoding unit and the second encoding unit. The encoding device comprises a first encoding determination unit that determines whether the first or second encoding unit is used to encode an encoding target frame that is included in the audio signal. The encoding device of the present invention further comprises a second coding determination unit that determines, if the first coding determination unit determines that the encoding target frame is to be encoded by the first encoding unit, whether a frame immediately preceding the encoding target frame has been encoded by the first encoding unit or the second encoding unit, and a coding internal state calculation unit that decodes, if the second coding determination unit determines that the immediately preceding frame has been encoded by the second encoding unit, an encoded result of the immediately preceding frame and calculates an internal state of the first encoding unit, using the decoded result. The encoding device of the present invention further comprises a coding initialization unit that initializes an internal state of the first encoding unit, using the internal state calculated by the coding internal state calculation unit. The first encoding unit encodes the encoding target frame after the coding initialization unit initializes the internal state thereof.

According to the encoding device of the present invention, even when the encoding target frame is to be encoded by the first encoding unit operating under a linear predictive coding scheme, whereas the immediately preceding frame is encoded by the second encoding unit operating under a coding scheme different from the linear predictive coding scheme, the encoding target frame can be encoded under the linear predictive coding scheme by initializing the internal state of the first encoding unit. Therefore, coding processing performed under a plurality of coding schemes including the linear predictive coding scheme and a coding scheme different from the linear predictive coding scheme can be realized.

A decoding device of the present invention includes a first decoding unit operating under a linear predictive coding scheme and a second decoding unit operating under a coding scheme different from the linear predictive coding scheme and decodes an encoded audio signal, using the first decoding unit and the second decoding unit. The decoding device comprises a first decoding determination unit that determines whether the first decoding unit or the second decoding unit is used to decode a decoding target frame that is included in the encoded audio signal. The decoding device also comprises a second decoding determination unit that determines, if the first decoding determination unit determines that the decoding target frame is to be decoded by the first decoding unit, whether a frame immediately preceding the decoding target frame has been decoded by the first decoding unit or the second decoding unit. The decoding device further comprises a decoding internal state calculation unit that calculates, if the second decoding determination unit determines that the immediately preceding frame has been decoded by the second decoding unit, an internal state of the first decoding unit, using a decoded result of the immediately preceding frame, and a decoding initialization unit that initializes an internal state of the first decoding unit, using the internal state calculated by the decoding internal state calculation unit. The first decoding unit decodes the decoding target frame after the internal state thereof is initialized by the decoding initialization unit.

According to the decoding device of the present invention, even when the decoding target frame is to be decoded by the first decoding unit operating under a linear predictive coding scheme, whereas the immediately preceding frame is decoded by the second decoding unit operating under a coding scheme different from the linear predictive coding scheme, the decoding target frame can be decoded under the linear predictive coding scheme by initializing the internal state of the first decoding unit. Therefore, decoding processing performed under a plurality of coding schemes including the linear predictive coding scheme and a coding scheme different from the linear predictive coding scheme can be realized.

An audio signal processing system of the present invention includes the encoding device and the decoding device. The decoding device decodes an encoded audio signal encoded by the encoding device.

According to the audio signal processing system of the present invention, even when the encoding target frame is to be encoded by the first encoding unit operating under a linear predictive coding scheme, whereas the immediately preceding frame is encoded by the second encoding unit operating under a coding scheme different from the linear predictive coding scheme, the encoding target frame can be encoded under the linear predictive coding scheme by initializing the internal state of the first encoding unit. Even when the decoding target frame is to be decoded using the first decoding unit operating under a linear predictive coding scheme, whereas the immediately preceding frame is decoded by the second decoding unit operating under a coding scheme different from the linear predictive coding scheme, the decoding target frame can be decoded under the linear predictive coding scheme by initializing the internal state of the first decoding unit. Therefore, encoding processing and decoding processing performed under a plurality of coding schemes including the linear predictive coding scheme and another coding scheme different from the linear predictive coding scheme can be realized.

A storage medium of the present invention stores an audio signal encoding program for encoding an audio signal, using a first encoding unit operating under a linear predictive coding scheme and a second encoding unit operating under a coding scheme different from the linear predictive coding scheme. The program causes a computer to determine whether the first encoding unit or the second encoding unit is used to encode an encoding target frame that is included in the audio signal. The program also causes the computer to determine, if the encoding target frame is determined to be encoded by the first encoding unit, whether a frame immediately preceding the encoding target frame has been encoded by the first encoding unit or the second encoding unit. If the immediately preceding frame is determined to have been encoded by the second encoding unit, the computer decodes a encoded result of the immediately preceding frame and calculates an internal state of the first encoding unit, using the decoded result. The program further causes the computer to initialize an internal state of the first encoding unit, using the internal state calculated by the coding internal state calculation unit, and encode the encoding target frame by the first encoding unit after the internal state thereof is initialized.

According to the storage medium of the present invention which stores the audio signal encoding program, even when the encoding target frame is to be encoded by the first encoding unit operating under a linear predictive coding scheme, whereas the immediately preceding frame is encoded by the second encoding unit operating under a coding scheme different from the linear predictive coding scheme, the encoding target frame can be encoded under the linear predictive coding scheme by initializing the internal state of the first encoding unit. Therefore, encoding processing performed under a plurality of coding schemes including the linear predictive coding scheme and a coding scheme different from the linear predictive coding scheme can be realized.

A storage medium of the present invention stores an audio signal decoding program for decoding an encoded audio signal, using a first decoding unit operating under a linear predictive coding scheme and a second decoding unit operating under a coding scheme different from the linear predictive coding scheme. The program causes a computer to determine whether the first decoding unit or the second decoding unit is used to decode a decoding target frame that is included in the encoded audio signal. If the decoding target frame is determined to be decoded by the first decoding unit, the computer determines whether a frame immediately preceding the decoding target frame has been decoded by the first decoding unit or the second decoding unit. If the immediately preceding frame has been decoded by the second decoding unit, the computer calculates an internal state of the first decoding unit, using a decoded result of the immediately preceding frame, and initializes an internal state of the first decoding unit, using the internal state calculated by the decoding internal state calculation unit. The computer then decodes the decoding target frame by the first decoding unit after the internal state thereof is initialized.

According to the storage medium of the present invention which stores the audio signal decoding program, even when the decoding target frame is to be decoded using the first decoding unit operating under a linear predictive coding scheme, whereas the immediately preceding frame is decoded by the second decoding unit operating under a coding scheme different from the linear predictive coding scheme, the decoding target frame can be decoded under the linear predictive coding scheme by initializing the internal state of the first decoding unit. Therefore, decoding processing performed under a plurality of coding schemes including the linear predictive coding scheme and a coding scheme different from the linear predictive coding scheme can be realized.

According to the present invention, when switching from a coding scheme not using the linear prediction to a coding scheme using the linear predictive coding, the internal state of the encoding unit or the decoding unit exercising a coding scheme using the linear predictive encoding can be initialized to appropriate values, and the quality of a speech reproduced from the frame coming immediately after the switching can be improved.

DETAILED DESCRIPTION OF THE PREFERRED EMBODIMENTS

Figure 1:
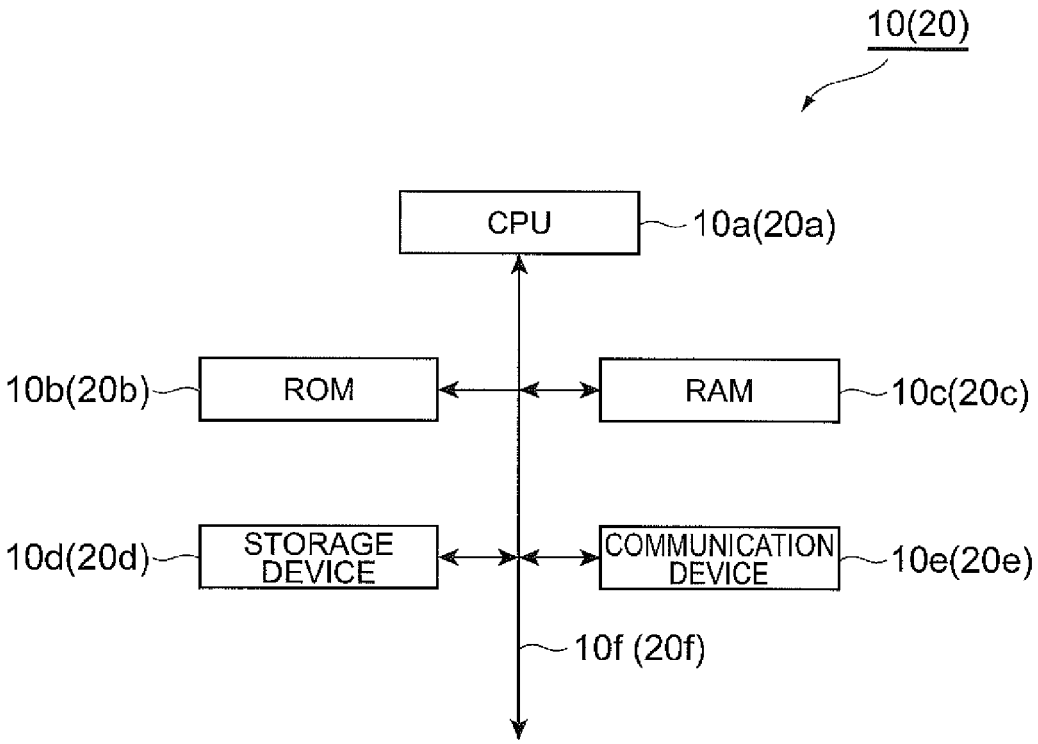
FIG. 1 is a diagram showing a configuration of an encoding device and a decoding device according to an embodiment.
Figure 2:
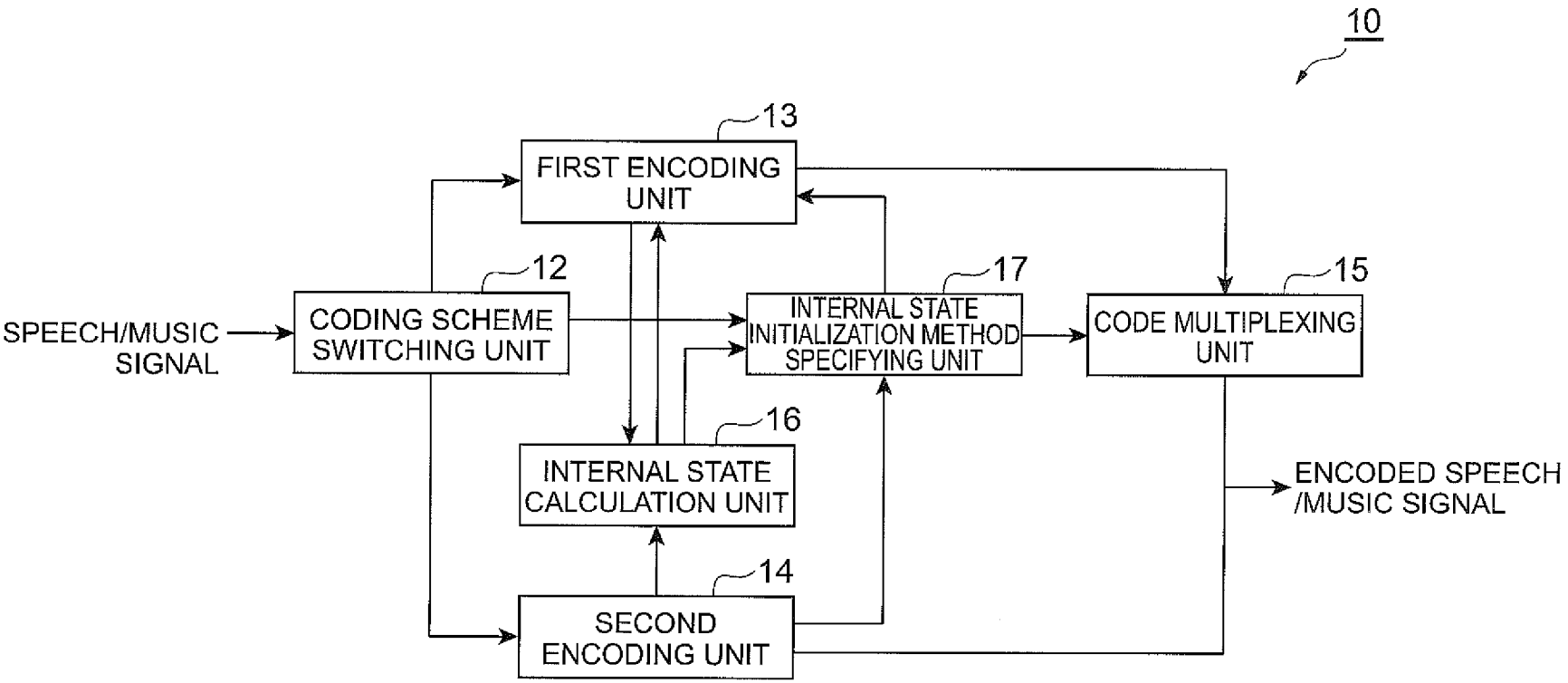
FIG. 2 is a diagram showing a configuration of the encoding device according to the embodiment.

A preferable embodiment of the present invention is described below in detail with reference to the accompanying drawings. In the description of the drawings, the same elements are labeled with the same reference numerals, if possible, and descriptions thereof are not repeated. An audio signal processing system according to an embodiment includes an encoding device 10 which encodes an input audio signal and a decoding device 20 which decodes an encoded audio signal encoded by the encoding device 10. FIG. 1 and FIG. 2 are diagrams showing a configuration of the encoding device 10 according to the embodiment. The encoding device 10 encodes an input speech/music signal (audio signal) and outputs the encoded signal. The speech/music signal is first divided into frames having a finite length and thereafter inputted to the encoding device 10. The encoding device 10 performs encoding using a first coding scheme when the speech/music signal is a speech signal, and performs encoding using a second coding scheme when the speech/music signal is a music signal. The first coding scheme may be the CELP scheme such as ACELP based on linear predictive coding having an adaptive codebook. The second coding scheme is a coding scheme different from the first coding scheme and not utilizing the linear prediction. The second coding scheme may, for example, be a transform coding scheme such as AAC.

The encoding device 10 physically includes a computer device including a CPU 10*a*, a ROM 10*b*, a RAM 10*c*, a storage device 10*d*, a communication device 10*e*, and the like. The CPU 10*a*, the ROM 10*b*, the RAM 10*c*, the storage device 10*d*, and the communication device 10*e* are connected to a bus 10*f*. The CPU 10*a* centrally performs control of the encoding device 10 by executing a preset computer program (for example, an audio signal encoding program for executing the process shown in the flowchart of FIG. 3), which is stored in an internal memory such as the ROM 10*b* and loaded therefrom onto the RAM 10*c*. The storage device 10*d* is a writable and readable memory and stores a variety of computer programs, a variety of data required to execute computer programs (for example, an adaptive codebook and linear predictive coefficients used for encoding under the first coding scheme, and in addition, various parameters required for encoding under the first coding scheme and the second coding scheme, and a predetermined number of pre-coded and coded frames). The storage device 10*d* stores at least a frame of speech/music signal coded most recently (a latest coded frame).

The encoding device 10 functionally includes a coding scheme switching unit 12 (first coding determination unit, second coding determination unit), a first encoding unit 13 (first encoding unit), a second encoding unit 14 (second encoding unit), a code multiplexing unit 15, an internal state calculation unit 16 (internal coding state calculation unit), and an internal state initialization method specifying unit 17 (coding initialization unit). The coding scheme switching unit 12, the first encoding unit 13, the second encoding unit 14, the code multiplexing unit 15, the internal state calculation unit 16, and the internal state initialization method specifying unit 17 are functions implemented by the CPU 10*a* executing the computer programs stored in an internal memory of the encoding device 10, such as the ROM 10*b*, to operate each component of the encoding device 10 shown in FIG. 1. The CPU 10*a* executes the process shown in the flowchart in FIG. 3 by executing an audio signal encoding program (using the coding scheme switching unit 12, the first encoding unit 13, the second encoding unit 14, the code multiplexing unit 15, the internal state calculation unit 16, and the internal state initialization method specifying unit 17).

Figure 3:
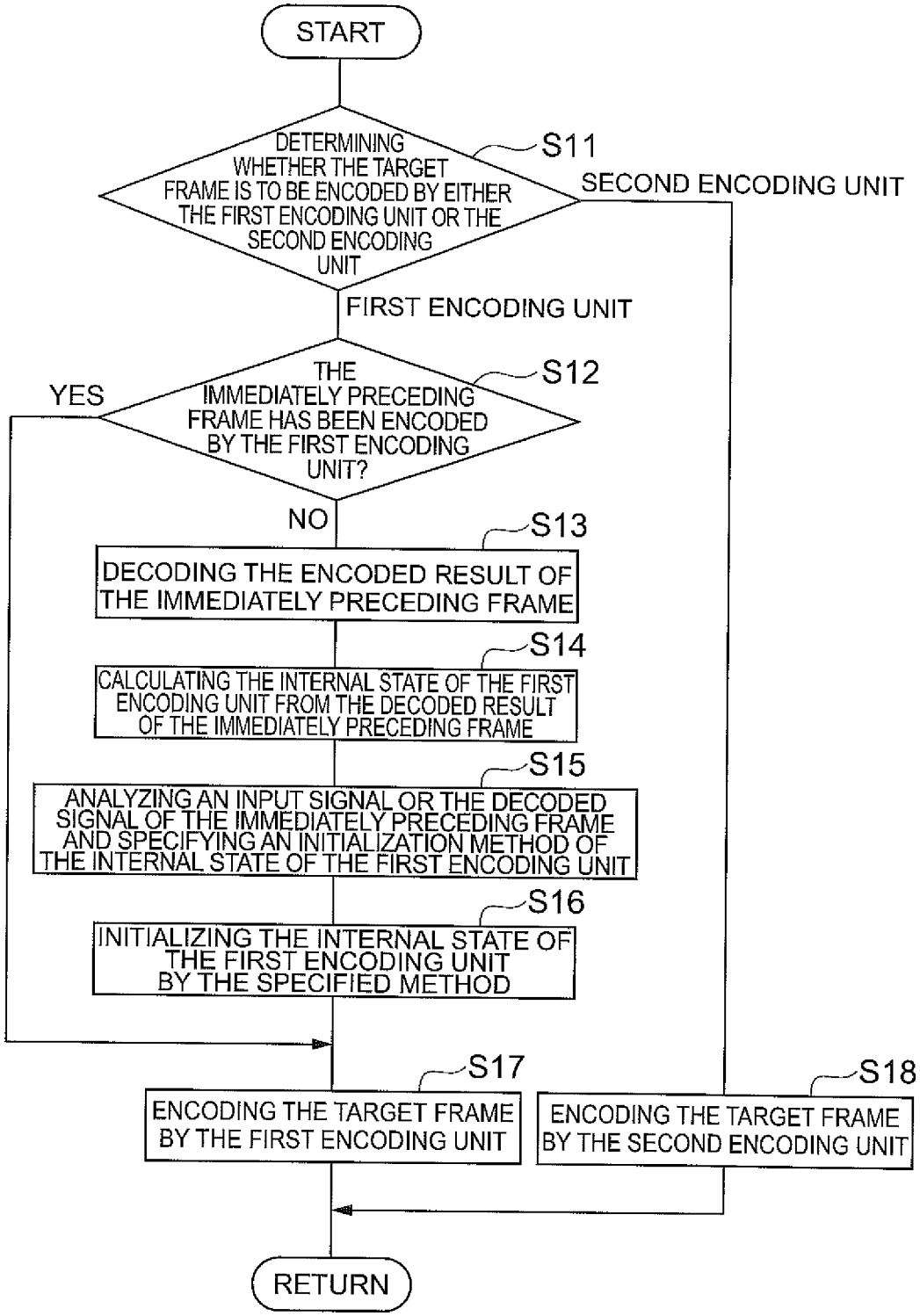
FIG. 3 is a flowchart to describe an operation of the encoding device according to the embodiment.

Next, referring to FIG. 3, the operation of the encoding device 10 is described. A speech/music signal is first divided into frames having a finite length and then inputted to the communication device 10*e* of the encoding device 10. When a speech/music signal is inputted through the communication device 10*e*, the coding scheme switching unit 12 determines, based on an encoding target frame (a frame that is a target of encoding) of the speech/music signal, whether the first coding scheme or the second coding scheme is used to encode the encoding target frame and, based on the determination, sends the encoding target frame to either the first encoding unit 13, which exercises the first coding scheme to encode a speech/music signal, or the second encoding unit 14, which exercises the second coding scheme to encode a speech/music signal (step S11; a first switching step). In step S11, the coding scheme switching unit 12 determines that encoding is to be performed by the first coding scheme if the encoding target frame is a speech signal and that encoding is to be performed by the second coding scheme if the encoding target frame is a music signal. Then, after this first switching step, a first initialization step (steps S12 to S18) is performed for initializing the internal state of the first encoding unit 13 (which is hereinafter referred to as including the content of an adaptive codebook or values held by delay elements of a linear predictive synthesis filter which calculates a zero input response, etc.)

If the coding scheme switching unit 12 determines in step S11 that the encoding target frame is a music signal and that the encoding target frame is to be encoded by the second coding scheme (step S11: SECOND ENCODING UNIT), the coding scheme switching unit 12 sends the encoding target frame to the second encoding unit 14, and the second encoding unit 14 encodes the encoding target frame sent from the coding scheme switching unit 12, using the second coding scheme, and outputs the encoded target frame (encoded speech/music signal) through the communication device 10*e* (step S18). If the coding scheme switching unit 12 determines in step S11 that the encoding target frame is a speech signal and that the encoding target frame is to be encoded by the first coding scheme (step S11: FIRST ENCODING UNIT), the coding scheme switching unit 12 refers to the content of the storage device 10*d* and determines whether a frame immediately preceding the encoding target frame (the immediately preceding frame) has been encoded by the first encoding unit 13 or encoded by the second encoding unit 14 (step S12). The encoded results of a predetermined number of encoded frames (including the immediately preceding frame and frames preceding the encoding target frame) and frames yet to be encoded are all stored in the storage device 10*d*.

If the coding scheme switching unit 12 determines in step S12 that the immediately preceding frame has been encoded by the first encoding unit 13 (step S12; YES), the coding scheme switching unit 12 sends the encoding target frame to the first encoding unit 13, and the first encoding unit 13 encodes the encoding target frame sent from the coding scheme switching unit 12, using the first coding scheme, and outputs the encoded result of the encoding target frame (encoded speech/music signal) through the communication device 10*e* (step S17). If the coding scheme switching unit 12 determines in step S12 that the immediately preceding frame has been encoded by the second encoding unit 14 (step S12; NO), the internal state calculation unit 16 decodes the encoded result of the immediately preceding frame stored in the storage device 10*d* and obtains the decoded result of the immediately preceding frame (step S13). The decoded result used by the encoding device 10 is obtained by a decoder (not shown) included in the encoding device 10 or the decoding device 20 described later. This decoding operation may not be necessary if the immediately preceding frame yet to be encoded by the second encoding unit 14 is used, in place of the decoded result obtained by decoding the encoded result of the immediately preceding frame. This immediately preceding frame yet to be encoded is stored in the storage device 10*d*.

After step S13, the internal state calculation unit 16 calculates the internal state of the first encoding unit 13 using the decoded result of the immediately preceding frame (step S14). As an exemplary process of calculating the internal state with the decoded result of the immediately preceding frame, the process of calculating the internal state of the first encoding unit 13, which is performed by the internal state calculation unit 16, includes a process of calculating linear predictive coefficients, using a method such as a covariance method, from the decoded result of the immediately preceding frame (or the immediately preceding frame yet to be encoded by the second encoding unit 14) and then obtaining a residual signal by applying a linear predictive inverse filter to the decoded result, using the calculated linear predictive coefficients.

Since the process of calculating linear predictive coefficients from the decoded result of the immediately preceding frame requires a large amount of calculation, instead of calculating the linear predictive coefficients from the decoded result of the immediately preceding frame, the internal state calculation unit 16 may use the linear predictive coefficients (stored in the storage device 10*d*) of a frame neighboring the immediately preceding frame (a frame preceding the immediately preceding frame) which is encoded by the first coding scheme, in place of the linear predictive coefficients used in the aforementioned process (the process of calculating the internal state of the first encoding unit 13), or may use values obtained by interpolating those linear predictive coefficients between frames, in place of the linear predictive coefficients used in the aforementioned process (the process of calculating the internal state of the first encoding unit 13). The internal state calculation unit 16 may use values obtained by extrapolating the linear predictive coefficients of frames neighboring the immediately preceding frame which is encoded under the first coding scheme or values obtained by extrapolating values obtained by interpolating the linear predictive coefficients between frames, in place of the linear predictive coefficients used in the aforementioned process (the process of calculating the internal state of the first encoding unit 13). The internal state calculation unit 16 may convert the linear predictive coefficients into linear spectral frequencies, extrapolate the linear spectral frequencies and reconvert the extrapolated result back into linear predictive coefficients. If the linear predictive coefficients of the immediately preceding frame are included in the codes of the encoding target frame, the internal state calculation unit 16 may use the linear predictive coefficients included in the codes of the encoding target frame in place of the linear predictive coefficients used in the aforementioned process (the process of calculating the internal state of the first encoding unit 13). The internal state calculation unit 16 may use the decoded result of the immediately preceding frame as it is as a replacement for the residual signal, without calculating the linear predictive coefficients. The internal state of the first encoding unit 13 may be initialized by using the internal state (information indicating the internal state is stored in the storage device 10*d*) obtained during the process of encoding a frame neighboring the immediately preceding frame (and preceding the immediately preceding frame) which is encoded under the first coding scheme. The process of applying the linear predictive inverse filter to the decoded result of the immediately preceding frame may not be performed on the entire frame but may be performed on only a part of the frame.

After step S14, the internal state initialization method specifying unit 17 specifies, based on the encoding target frame or the decoded result of the immediately preceding frame, one of predetermined initialization methods including a method of initializing the internal state of the first encoding unit 13, using the internal state calculated by the internal state calculation unit 16, a method of initializing the internal state with "0", and the like (step S15). Then, the internal state initialization method specifying unit 17 initializes the internal state of the first encoding unit 13 by executing the initialization method specified in step S15 (step S16). Initialization of the internal state of the first encoding unit 13, which is performed by the internal state initialization method specifying unit 17, is a process of initializing the internal state of the first encoding unit 13 using the internal state calculated by the internal state calculation unit 16 and may include a process of initializing the internal state (indicating values held by delay elements) of the linear predictive synthesis filter of the first encoding unit 13 for use in calculating the residual signal under the first coding scheme. When specifying a method of initializing the internal state of the first encoding unit 13, the internal state initialization method specifying unit 17 may, for example, encode the encoding target frame using the first coding scheme according to each of a plurality of initialization methods including the above two initialization methods and select an initialization method minimizing square error or perceptual weighted error.

After the internal state initialization method specifying unit 17 initializes the internal state of the first encoding unit 13 in step S16, the first encoding unit 13 encodes the encoding target frame under the first coding scheme and outputs the encoded result of the encoding target frame (encoded speech/music signal) through the communication device 10*e* (step S17).

The above process may be so configured that the code multiplexing unit 15 multiplexes information of the initialization method selected by the internal state initialization method specifying unit 17 in step S15, as supplemental information, into the encoded result obtained under the first coding scheme. It may also be so configured to specify the initialization method of the internal state of the first encoding unit 13, based on information (described below) obtained in common between the first encoding unit 13 and the second encoding unit 14, and the decoder (the decoder included in the encoding device 10 or the decoding device 20). In this case, the code multiplexing unit 15 does not multiplex the supplemental information indicating the specified initialization method for initializing the internal state of the first encoding unit 13 into the encoded result. For example, when the adaptive codebook gain of the encoding target frame under the first coding scheme is large, or when the periodicity of the decoded result in the immediately preceding frame is high, or in the similar cases, the internal state initialization method specifying unit 17 can initialize the internal state of the first encoding unit 13 using the internal state calculated by the internal state calculation unit 16.

Alternatively, the internal state initialization method specifying unit 17 may be dispensed with if the first encoding unit 13 always initializes the internal state thereof using the internal state calculated by the internal state calculation unit 16. Although the internal state calculation unit 16 and the internal state initialization method specifying unit 17 are configured to perform the aforementioned process (the first initialization step) on the encoding target frame immediately after the coding scheme switching unit 12 switches from the second coding scheme to the first coding scheme (after the first switching step), it needs not be so limited if the internal state calculation unit 16 and the internal state initialization method specifying unit 17 perform the aforementioned process when the immediately preceding frame (immediately before the encoding target frame) is encoded immediately before the coding scheme switching unit 12 switches from the second coding scheme to the first coding scheme. Although it has been discussed that switching is performed between the two coding schemes, that is, the first coding scheme (the first encoding unit 13) and the second coding scheme (the second encoding unit 14), switching may be performed among three or more coding schemes including a plurality of coding schemes different from the first coding scheme.

Figure 4:
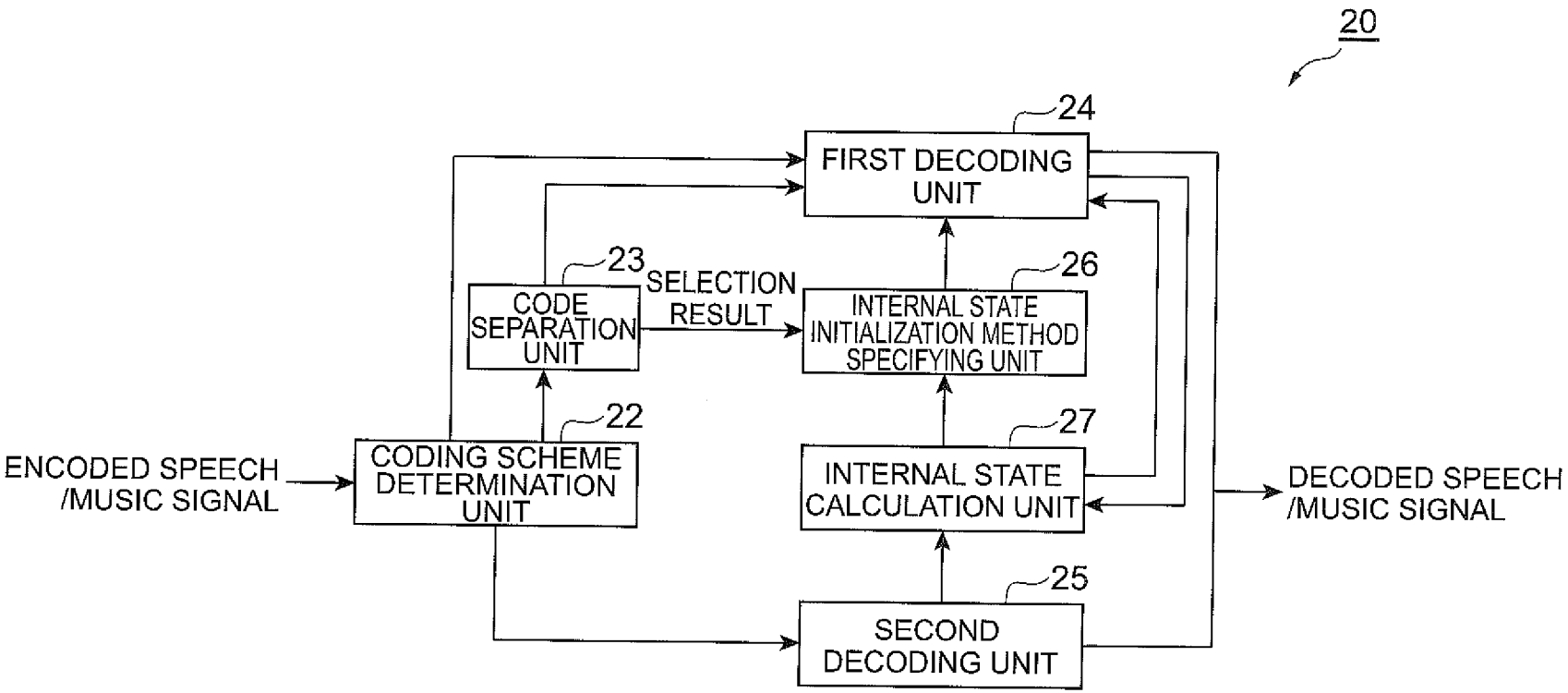
FIG. 4 is a diagram showing a configuration of a decoding device according to the embodiment.

FIG. 1 and FIG. 4 are diagrams showing the configuration of the decoding device 20 according to one embodiment. The decoding device 20 physically includes a computer device including a CPU 20*a*, a ROM 20*b*, a RAM 20*c*, a storage device 20*d*, a communication device 20*e*, and the like. The CPU 20*a*, the ROM 20*b*, the RAM 20*c*, the storage device 20*d*, and the communication device 20*e* are connected to a bus 20*f*. The CPU 20*a* centrally performs control of the decoding device 20 by executing a preset computer program (for example, an audio signal decoding program for executing the process shown in the flowchart of FIG. 5) which is stored in an internal memory, such as the ROM 20*b* and loaded onto the RAM 20*c*. The storage device 20*d* is a writable and readable memory and stores a variety of computer programs, a variety of data required to execute computer programs (including, for example, an adaptive codebook and linear predictive coefficients used in decoding under the first coding scheme, and in addition, various parameters required for performing decoding under the first coding scheme and the second coding scheme, a prescribed number of decoded frames and frames before decoding, and the like). The storage device 20*d* stores at least a speech/music signal decoded most recently (a latest decoded frame).

The decoding device 20 functionally includes a coding scheme determination unit 22 (first decoding determination unit, second decoding determination unit), a code separation unit 23, a first decoding unit 24 (first decoding unit), a second decoding unit 25 (second decoding unit), an internal state initialization method specifying unit 26 (decoding initialization unit), and an internal state calculation unit 27 (decoding internal state calculation unit). The coding scheme determination unit 22, the code separation unit 23, the first decoding unit 24, the second decoding unit 25, the internal state initialization method specifying unit 26, and the internal state calculation unit 27 are functions implemented by the CPU 20*a* executing the computer program stored in an internal memory of the decoding device 20, such as the ROM 20*b*, to operate each component of the decoding device 20 shown in FIG. 1. The CPU 20*a* executes the process shown in the flowchart of FIG. 5 by executing the audio signal decoding program (using the coding scheme determination unit 22, the code separation unit 23, the first decoding unit 24, the second decoding unit 25, the internal state initialization method specifying unit 26, and the internal state calculation unit 27).

Figure 5:
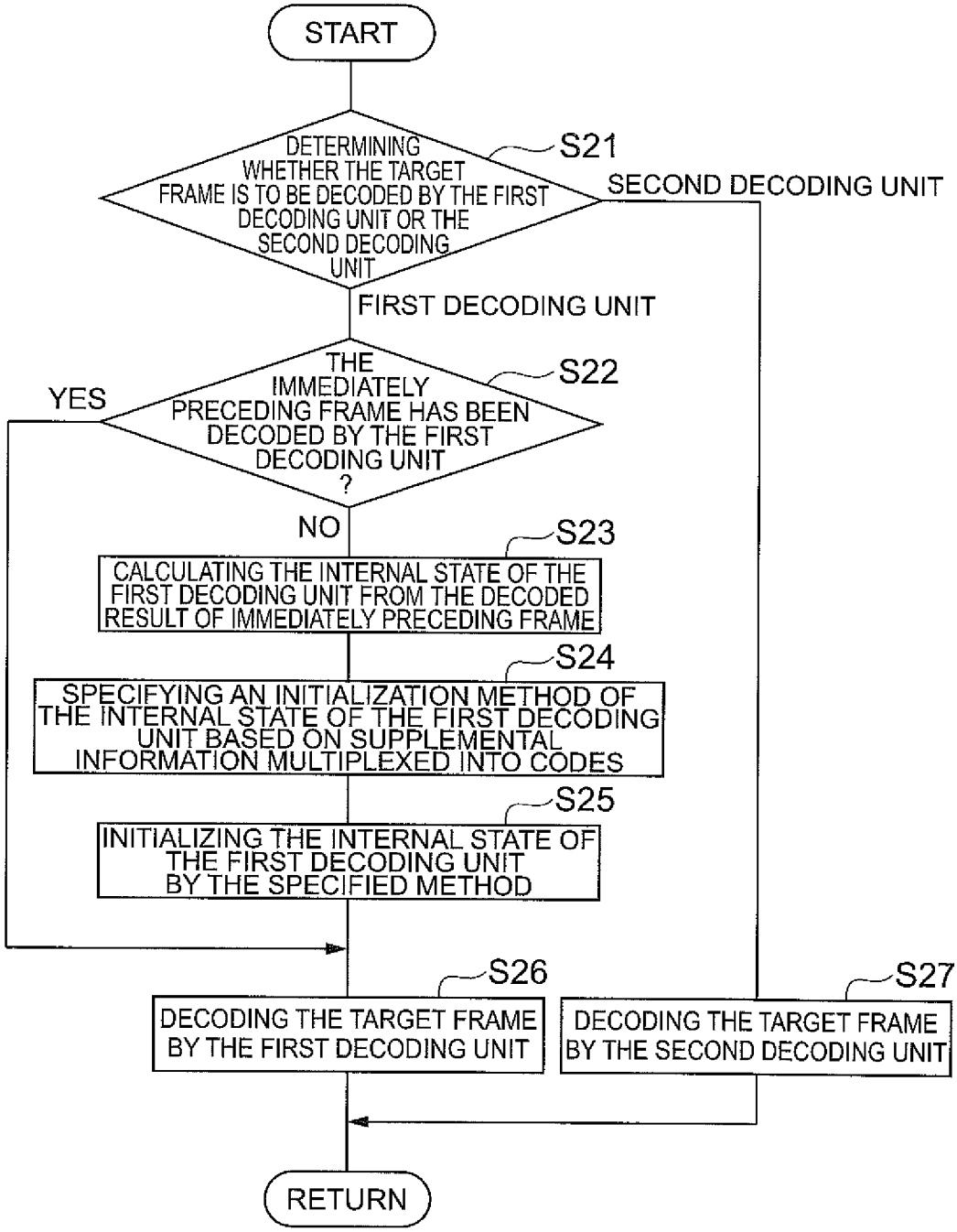
FIG. 5 is a flowchart to describe an operation of the decoding device according to the embodiment.

Next, referring to FIG. 5, the operation of the decoding device 20 is described. The coding scheme determination unit 22 determines whether the first coding scheme or the second coding scheme has been used to encode a decoding target frame of an encoded speech/music signal inputted through the communication device 20*e* and, based on the determination result, sends the decoding target frame to either the first decoding unit 24 for applying decoding under the first coding scheme or the second decoding unit 25 for applying decoding under the second coding scheme (step S21; a second switching step). In step S21, the coding scheme determination unit 22 determines that decoding is to be performed by the first decoding unit 24 if the decoding target frame has been encoded under the first coding scheme and that decoding is to be performed by the second decoding unit 25 if the decoding target frame has been encoded under the second coding scheme. Then, after this second switching step, a second initialization step (steps S22 to S27) is performed in which the internal state of the first decoding unit 24 (which is hereinafter referred to as including the content of an adaptive codebook or values held by delay elements of a linear predictive synthesis filter, or the like) is initialized.

If the coding scheme determination unit 22 determines in step 21 that the decoding target frame has been encoded under the second coding scheme (that is, the decoding target frame is to be decoded by the second decoding unit 25) (step S21: SECOND DECODING UNIT), the coding scheme determination unit 22 sends the decoding target frame to the second decoding unit 25, and the second decoding unit 25 decodes the decoding target frame sent from the coding scheme determination unit 22 under the second coding scheme and outputs the decoded result of the decoding target frame (decoded speech/music signal) through the communication device 20*e* (step S27). If the coding scheme determination unit 22 determines in step S21 that the decoding target frame has been encoded under the first coding scheme (that is, the decoding target frame is to be decoded by the first decoding unit 24) (step S21: FIRST DECODING UNIT), the coding scheme determination unit 22 refers to the content of the storage device 20*d* and determines whether the frame immediately before the decoding target frame (the immediately preceding frame) has been encoded under the first coding scheme (that is, the immediately preceding frame has been decoded by the first decoding unit 24) or encoded under the second coding scheme (that is, the immediately preceding frame has been decoded by the second decoding unit 25) (step S22). The decoded results of a predetermined number of decoded frames (including the immediately preceding frame and frames preceding the decoding target frame) and frames yet to be decoded are all stored in the storage device 20*d*.

If the coding scheme determination unit 22 determines in step S22 that the immediately preceding frame has been encoded under the first coding scheme (that is, the immediately preceding frame has been decoded by the first decoding unit 24) (step S22; YES), the coding scheme determination unit 22 sends the decoding target frame to the first decoding unit 24, and the first decoding unit 24 decodes the decoding target frame sent form the coding scheme determination unit 22 under the first coding scheme and outputs the decoded result of the decoding target frame (decoded speech/music signal) through the communication device 20*e* (step S26).

If the coding scheme determination unit 22 determines in step S22 that the immediately preceding frame has been encoded under the second coding scheme (that is, the immediately preceding frame has been decoded by the second decoding unit 25) (step S22; NO), the coding scheme determination unit 22 sends the immediately preceding frame to the code separation unit 23, and the code separation unit 23 separates the multiplexed codes of the immediately preceding frame into codes of the first coding scheme and supplemental information indicating the initialization method of the internal state of the first decoding unit 24 (for example, information indicating the initialization method of the internal state of the first encoding unit 13 which is specified by the internal state initialization method specifying unit 17 and is used when the immediately preceding frame is encoded). Then, the internal state calculation unit 27 calculates the internal state of the first decoding unit 24 using the decoded result of the immediately preceding frame (step S23). As an exemplary process of calculating the internal state from the decoded result of the immediately preceding frame, the process of calculating the internal state of the first decoding unit 24, which is performed by the internal state calculation unit 27, includes a process of calculating linear predictive coefficients, using a method such as a covariance method, from the decoded result of the immediately preceding frame and then calculating a residual signal by applying a linear predictive inverse filter to the decoded result, using the calculated linear predictive coefficients.

Since the process of calculating linear predictive coefficients from the decoded result of the immediately preceding frame requires a large amount of calculation, instead of calculating the linear predictive coefficients from the decoded result of the immediately preceding frame, the internal state calculation unit 27 may use linear predictive coefficients, (which are the linear predictive coefficients used at the time of decoding by the first decoding unit 24 and are stored in the storage device 20*d*) of a frame neighboring the immediately preceding frame (and preceding the immediately preceding frame) which is encoded under the first coding scheme, in place of the linear predictive coefficients used in the aforementioned process (the process of calculating the internal state of the first decoding unit 24), or may use values obtained by interpolating the linear predictive coefficients between frames, in place of the linear predictive coefficients used in the aforementioned process (the process of calculating the internal state of the first decoding unit 24). The internal state calculation unit 27 may use values obtained by extrapolating the linear predictive coefficients of a frame neighboring the immediately preceding frame which is encoded under the first coding scheme or values obtained by extrapolating values obtained by interpolating the linear predictive coefficients between frames, in place of the linear predictive coefficients used in the aforementioned process (the process of calculating the internal state of the first decoding unit 24). The internal state calculation unit 27 may convert the linear predictive coefficients into linear spectral frequencies, extrapolate the linear spectral frequencies and reconvert the extrapolated result back into linear predictive coefficients. If the linear predictive coefficients of the immediately preceding frame are included in the codes of the decoding target frame, the internal state calculation unit 27 may use the linear predictive coefficients included in the codes of the decoding target frame, in place of the linear predictive coefficients used in the aforementioned process (the process of calculating the internal state of the first decoding unit 24). Alternatively, calculation of the linear predictive coefficients may be dispensed with by omitting application of the linear predictive inverse filter. Furthermore, the internal state of the first decoding unit 24 may be initialized by using the internal state (information indicating the internal state is stored in the storage device 20*d*) obtained during the process of decoding a frame neighboring the immediately preceding frame (and preceding the immediately preceding frame) which is encoded under the first coding scheme. The process of applying the linear predictive inverse filter to the decoded result of the immediately preceding frame may not be performed on the entire frame but may be performed on only a part of the frame.

After step S23, the internal state initialization method specifying unit 26 specifies, based on the supplemental information included in the multiplexed codes of the immediately preceding frame and indicating the initialization method of the internal state of the first decoding unit 24, one of predetermined initialization methods including a method of initializing the internal state of the first decoding unit 24, using the internal state calculated by the internal state calculation unit 27, a method of initializing by "0", and the like (step S24). Then, the internal state initialization method specifying unit 26 initializes the internal state of the first decoding unit 24 according to the initialization method specified in step S24 (step S25). The initialization of the internal state of the first decoding unit 24, which is performed by the internal state initialization method specifying unit 26, is a process of initializing the internal state of the first decoding unit 24, using the internal state calculated by the internal state calculation unit 27, and may include a process of initializing the internal state (the values held by the delay elements) of the linear predictive synthesis filter of the first decoding unit 24, which calculates an output signal from a residual signal under the first coding scheme.

After the internal state initialization method specifying unit 26 initializes the internal state of the first decoding unit 24 in step S25, the first decoding unit 24 decodes the decoding target frame in accordance with the first coding scheme and outputs the decoded result of the decoding target frame (decoded speech/music signal) through the communication device 20*e* (step S26).

If the supplemental information indicating an initialization method of initializing the internal state of the first decoding unit 24 is not multiplexed into the codes of the immediately preceding frame, an initialization method of initializing the internal state of the first decoding unit 24 may be specified, using a fixed codebook gain of the decoding target frame under the first coding scheme or the result of analyzing the periodicity of the decoded result in the immediately preceding frame or the like (using information obtained in common from the first decoding unit 24 and the second decoding unit 25, and the encoder (the encoder included in the decoding device 20 or the first encoding unit 13)). It may be so configured that the internal state initialization method specifying unit 26 is dispensed with if the first decoding unit 24 always initializes the internal state thereof using the internal state calculated by the internal state calculation unit 27. In this case, it is not necessary to use the supplemental information indicating the initialization method which is multiplexed into the codes of the immediately preceding frame. Although the operation of the internal state calculation unit 27 and the operation of the internal state initialization method specifying unit 26 are described above in relation to the case where the immediately preceding frame has been encoded under the second coding scheme and the decoding target frame has been encoded under the first coding scheme, it is not so limited. If it is determined by look-ahead that the decoding target frame has been encoded under the second coding scheme and the frame immediately succeeding the decoding target frame has been encoded under the first coding scheme, the internal state calculation unit 27 and the internal state initialization method specifying unit 26 may perform calculation of the internal state for the first decoding unit 24 and selection of the internal state initialization method, based on the look-ahead information. Although the configuration has been discussed in which switching is performed between two coding schemes, that is, the first coding scheme and the second coding scheme, it may be so configured that switching is performed among three or more coding schemes including a plurality of coding schemes different from the first coding scheme.

Next, the operation and effect of the encoding device 10 according to the embodiment will be described. The encoding device 10 includes the first encoding unit 13 functioning under a linear predictive coding scheme and the second encoding unit 14 functioning under another coding scheme different from the linear predictive coding scheme and encodes an audio signal using the first encoding unit 13 and the second encoding unit 14. The encoding device 10 further includes the coding scheme switching unit 12, the internal state calculation unit 16, and the internal state initialization method specifying unit 17. The coding scheme switching unit 12 determines whether the first encoding unit 13 or the second encoding unit 14 should be used to encode an encoding target frame that is a target frame to be encoded included in the audio signal. If it is determined that the encoding target frame is to be encoded by the first encoding unit 13, the coding scheme switching unit 12 determines whether the frame immediately preceding the encoding target frame has been encoded by the first encoding unit 13 or the second encoding unit 14. If it is determined by the coding scheme switching unit 12 that the immediately preceding frame has been encoded by the second encoding unit 14, the internal state calculation unit 16 decodes the encoded result of the immediately preceding frame and calculates the internal state of the first encoding unit 13 using the decoded result. The internal state initialization method specifying unit 17 initializes the internal state of the first encoding unit 13 using the internal state calculated by the internal state calculation unit 16. Then, the first encoding unit 13 encodes the encoding target frame after the internal state is initialized by the internal state initialization method specifying unit 17.

In the encoding device 10, even when the encoding target frame is to be encoded by the first encoding unit 13 under a linear predictive coding scheme, whereas the immediately preceding frame has been encoded by the second encoding unit 14 under a coding scheme different from the linear predictive coding scheme, the encoding target frame can be encoded under the linear predictive coding scheme by initializing the internal state of the first encoding unit 13. Therefore, encoding processing performed under a plurality of encoding schemes including the linear predictive coding scheme and another coding scheme different from the linear predictive coding scheme can be realized.

Next, the operation and effect of the decoding device 20 according to the embodiment will be described. The decoding device 20 includes the first decoding unit 24 functioning under a linear predictive coding scheme and the second decoding unit 25 functioning under another coding scheme different from the linear predictive coding scheme and decodes an encoded audio signal, using the first decoding unit 24 and the second decoding unit 25. The decoding device 20 further includes the coding scheme determination unit 22, the internal state calculation unit 27, and the internal state initialization method specifying unit 26. The coding scheme determination unit 22 determines whether the first decoding unit 24 or the second decoding unit 25 should be used to decode a decoding target frame that is a target frame to be decoded included in an encoded audio signal. If it is determined by the coding scheme determination unit 22 that the decoding target frame is to be decoded by the first decoding unit 24, the coding scheme determination unit 22 determines whether a frame immediately preceding the decoding target frame has been decoded by the first decoding unit 24 or decoded by the second decoding unit 25. If it is determined by the coding scheme determination unit 22 that the immediately preceding frame has been decoded by the second decoding unit 25, the internal state of the first decoding unit 24 is calculated using the decoded result of the immediately preceding frame. The internal state of the first decoding unit 24 is initialized using the internal state calculated by the internal state calculation unit 27. Then, the first decoding unit 24 decodes the decoding target frame after the internal state is initialized according to the internal state initialization method specifying unit 26.

In the decoding device 20, even when the decoding target frame is to be decoded with the first decoding unit 24 under a linear predictive coding scheme, whereas the immediately preceding frame has been decoded by the second decoding unit 25 under a coding scheme different from the linear predictive coding scheme, the decoding target frame can be decoded under the linear predictive coding scheme by initializing the internal state of the first decoding unit 24. Therefore, decoding processing performed under a plurality of coding schemes including the linear predictive coding scheme and another coding scheme different from the linear predictive coding scheme can be realized.

When switching from a coding scheme not using linear prediction to a coding scheme using linear predictive coding, the internal state of encoding unit or decoding unit operating under the coding scheme using linear predictive coding is set to an appropriate initial value, whereby the quality of a speech reproduced form a frame coming immediately after the switching can be improved.

What is claimed is:

1. A method for encoding an audio signal including a plurality of frames, the method comprising:

using a first encoder operable under a linear predictive coding scheme and a second encoder operable under a coding scheme which is different from the linear predictive coding scheme to perform an audio signal encoding method comprising:

a switching step of switching, to encode a second frame immediately succeeding a first frame, from the second encoder to the first encoder after the first frame of the audio signal is encoded by the second encoder under the coding scheme which is different from the linear predictive coding scheme, the first frame being generated from a frame of the audio signal and the second frame being generated from another frame immediately succeeding the first frame in the audio signal; and an initialization step of initializing an internal state of the first encoder using a predetermined initialization method from among a plurality of predetermined initialization methods, the plurality of predetermined initialization methods comprising a first initialization method of initializing by zero the internal state of the first encoder and a second initialization method of initializing the internal state of the first encoder after the switching step, wherein, in the second initialization method, the internal state of the first encoder is initialized by setting a residual signal as content of an adaptive codebook of the first encoder, the residual signal obtained using a linear predictive inverse filter and a signal obtained by the second encoder decoding the first frame, and calculating linear predictive coefficients, which are used for the linear predictive inverse filter; and wherein the initialization step further comprises calculating the residual signal using the linear predictive coefficients.

2. A method for decoding an encoded audio signal, the encoded audio signal including a plurality of encoded frames generated from an audio signal including a plurality of frames, the method comprising:

using a first decoder operable under a linear predictive coding scheme and a second decoder operable under a coding scheme which is different from the linear predictive coding scheme to perform an audio signal decoding method comprising:

a switching step of switching, to decode a second frame immediately succeeding a first frame, from the second decoder to the first decoder after the first frame of the encoded audio signal is decoded by the second decoder, the first frame being generated from a frame of the audio signal and the second frame being generated from another frame immediately succeeding the first frame in the audio signal; and an initialization step of initializing an internal state of the first decoder by a predetermined initialization method from among a plurality of predetermined initialization methods, the plurality of predetermined initialization methods comprising a first initialization method of initializing by zero the internal state of the first decoder and a second initialization method of initializing the internal state of the first decoder after the switching step, wherein, in the second initialization method, the internal state of the first decoder is initialized by setting a residual signal as content of an adaptive codebook of the first decoder, and the residual signal is obtained using a linear predictive inverse filter and a signal obtained by the second decoder decoding the first frame, and wherein, the second initialization method further comprises calculating the residual signal using the linear predictive coefficients.

3. An encoding device comprising:

a first encoder operable under a linear predictive coding scheme;

a second encoder operable under a coding scheme which is different from the linear predictive coding scheme;

a first selector that determines whether the first or second encoder is used to encode a target frame that is included in an audio signal and serves as an encoding target;

a second selector that determines, if the first selector determines that the target frame is to be encoded by the first encoder, whether an immediately preceding frame that immediately precedes the target frame has been encoded by the first encoder or the second encoder;

an internal state calculator that decodes an encoded result of the immediately preceding frame and calculates a residual signal from the decoded result; and an initializer that initializes an adaptive codebook of the first encoder using the residual signal calculated by the internal state calculator and an initialization method, wherein the initialization method is from among a plurality of initialization methods, the plurality of initialization methods comprising a first initialization method of initializing by zero the internal state of the first encoder and a second initialization method of initializing the internal state of the first encoder after operation is switched to the linear predictive coding scheme from the coding scheme which is different from the linear predictive coding scheme, wherein, in the second initialization method, the internal state of the first encoder is initialized by the initializer by use of the residual signal as content of the adaptive codebook of the first encoder, the residual signal calculated by the internal state calculator using a linear predictive inverse filter and a signal obtained by the second encoder decoding the first frame, and calculation of linear predictive coefficients, which are used for the linear predictive inverse filter; and the first encoder is operable to encode the target frame after initialization of the adaptive codebook by the initializer.

4. A decoding device comprising:

a first decoder operable under a linear predictive coding scheme;

a second decoder operable under a coding scheme which is different from the linear predictive coding scheme;

a first selector that determines whether the first or second decoder is used to decode a target frame that is included in the encoded audio signal and serves as a decoding target;

a second selector that determines, if the first selector determines that the target frame is to be decoded by the first decoder, whether an immediately preceding frame that immediately precedes the target frame has been decoded by the first decoder or the second decoder;

an internal state calculator that calculates a residual signal from a decoded result of the immediately preceding frame; and an initializer that initializes an adaptive codebook of the first decoder using the residual signal calculated by the internal state calculator and an initialization method, wherein the initialization method is from among a plurality of predetermined initialization methods, the plurality of initialization methods comprising a first initialization method of initializing by zero the internal state of the first decoder and a second initialization method of initializing the internal state of the first decoder after operation is switched to the linear predictive coding scheme from the coding scheme which is different from the linear predictive coding scheme, wherein, in the second initialization method, the internal state of the first decoder is initialized by setting the residual signal as content of the adaptive codebook of the first decoder, the residual signal calculated by the internal state calculator using a linear predictive inverse filter and a signal obtained by the second decoder decoding the first frame, and the first decoder is operable to decode the target frame after initialization of the internal state thereof by the initializer.

5. An audio signal processing system comprising:

the encoding device according to claim 3; and the decoding device according to claim 4, wherein the decoding device decodes an encoded audio signal encoded by the encoding device.

6. A non-transitory storage medium that stores an audio signal encoding program, the storage medium comprising:

instructions executable to cause a first encoder to operate under a linear predictive coding scheme;

instructions executable to cause a second encoder to operate under a coding scheme which is different from the linear predictive coding scheme;

instructions executable to cause a first selector to determine whether the first or second encoder is used to encode a target frame that is included in the audio signal and serves as an encoding target;

instructions executable to cause a second selector, if the first selector determines that the target frame is to be encoded by the first encoder, to determine whether an immediately preceding frame that immediately precedes the target frame has been encoded by the first encoder or the second encoder;

instructions executable to cause an internal state calculator to decode an encoded result of the immediately preceding frame and calculate a residual signal from the decoded result if the second selector determines that the immediately preceding frame has been encoded by the second encoder, and operation is switched to the linear predictive coding scheme from the coding scheme which is different from the linear predictive coding scheme;

instructions executable to cause an initializer to initialize an adaptive codebook of the first encoder using the residual signal calculated by the internal state calculator and an initialization method, wherein the initialization method is from among a plurality of initialization methods, the plurality of initialization methods comprising a first initialization method of initializing by zero the internal state of the first encoder and a second initialization method of initializing the internal state of the first encoder after operation is switched to the linear predictive coding scheme from the coding scheme which is different from the linear predictive coding scheme, wherein, the second initialization method includes instructions executable to cause the initializer to initialize the internal state of the first encoder by use of the residual signal as content of the adaptive codebook of the first encoder, the residual signal calculated by the internal state calculator using a linear predictive inverse filter and a signal obtained by the second encoder decoding the first frame, and to cause calculation of linear predictive coefficients, which are used for the linear predictive inverse filter; and instructions executable to cause the first encoder to encode the target frame after initialization of the adaptive codebook by the initializer.

7. A non-transitory storage medium that stores an audio signal decoding program for decoding an encoded audio signal, the storage medium comprising:

instructions executable to cause a first decoder to operate under a linear predictive coding scheme;

instructions executable to cause a second decoder to operate under a coding scheme which is different from the linear predictive coding scheme, instructions executable to cause a first selector to determine whether the first or second decoder is used to decode a target frame that is included in the encoded audio signal and serves as a decoding target;

instructions executable to cause a second selector, if the first selector determines that the target frame is to be decoded by the first decoder, to determine whether an immediately preceding frame that immediately precedes the target frame has been decoded by the first decoder or the second decoder;

instructions executable to cause an internal state calculator to calculate a residual signal from a decoded result of the immediately preceding frame when the second selector determines that the immediately preceding frame has been decoded by the second decoder, and after operation is switched to the linear predictive coding scheme from the coding scheme which is different from the linear predictive coding scheme;

instructions executable to cause an initializer to initialize an adaptive codebook of the first decoder using the residual signal calculated by the internal state calculator and an initialization method, wherein the initialization method is from among a plurality of predetermined initialization methods, the plurality of initialization methods comprising a first initialization method of initializing by zero the internal state of the first decoder and a second initialization method of initializing the internal state of the first decoder after operation is switched to the linear predictive coding scheme from the coding scheme which is different from the linear predictive coding scheme, wherein, the second initialization method includes instructions to cause initialization of the internal state of the first decoder by setting the residual signal as content of the adaptive codebook of the first decoder, the residual signal calculated by the internal state calculator using a linear predictive inverse filter and a signal obtained by the second decoder decoding the first frame; and instructions executable to cause the first decoder to decode the target frame after initialization of the adaptive codebook by the initializer.

8. The encoding device of claim 3, wherein the initializer initializes the adaptive codebook of the first encoder using the residual signal calculated by the internal state calculator immediately after operation is switched to the linear predictive coding scheme from the coding scheme which is different from the linear predictive coding scheme.

9. The method of claim 1, wherein the first audio frame includes music content, and the second audio frame includes speech content.

10. The method of claim 2, wherein the first audio frame includes music content, and the second audio frame includes speech content.

* * * * *